US010648214B2

(12) United States Patent
Cummings

(10) Patent No.: US 10,648,214 B2
(45) Date of Patent: May 12, 2020

(54) AUTOMATIC LOCK-UNLOCK DOOR SAFETY CONTROL

(71) Applicant: Steve Cummings, Burnsville, MN (US)

(72) Inventor: Steve Cummings, Burnsville, MN (US)

( * ) Notice: Subject to any disclaimer, the term of this patent is extended or adjusted under 35 U.S.C. 154(b) by 589 days.

(21) Appl. No.: 15/432,705

(22) Filed: Feb. 14, 2017

(65) Prior Publication Data

US 2018/0230727 A1 Aug. 16, 2018

(51) Int. Cl.

| | |
|---|---|
| ***E05C 17/60*** | (2006.01) |
| ***E05F 3/22*** | (2006.01) |
| ***E05F 5/06*** | (2006.01) |
| ***E05C 17/12*** | (2006.01) |
| *E05B 47/00* | (2006.01) |

(52) U.S. Cl.

CPC ..... *E05D 13/04* (2013.01); *E05C 17/12* (2013.01); *E05F 3/222* (2013.01); *E05F 5/06* (2013.01); *E05B 47/0004* (2013.01); *E05B 2047/0058* (2013.01); *E05Y 2201/218* (2013.01); *E05Y 2201/418* (2013.01); *E05Y 2900/132* (2013.01); *Y10S 292/15* (2013.01); *Y10T 292/1082* (2015.04)

(58) Field of Classification Search

CPC ..... Y10S 292/15; E05C 17/12; E05F 3/222; E05D 13/04; Y10T 292/1082

See application file for complete search history.

(56) References Cited

U.S. PATENT DOCUMENTS 211,660 A * 1/1879 Hotchkiss ..... 16/64
1,895,146 A * 1/1933 Brown ..... E05C 17/50 292/228
1,940,027 A * 12/1933 Smith ..... E05F 3/222 292/201
1,987,330 A * 1/1935 Fischer ..... G08B 17/06 49/2
2,924,476 A * 2/1960 Deane ..... E05C 19/18 292/209
3,648,326 A * 3/1972 Gaysowski ..... E05F 3/222 16/48.5

(Continued)

FOREIGN PATENT DOCUMENTS

EP 479663 A1 * 4/1992
FR 1464119 A * 7/1966 ..... E05B 65/0811

(Continued)

*Primary Examiner* — Carlos Lugo
(74) *Attorney, Agent, or Firm* — Mark A. Litman & Associates, P.A.

(57) ABSTRACT

An electromechanical door supporting system for temporarily maintaining a door in an open position having:

a) a housing with an electric motor in communication with a power source;

b) a base plate sized to pass underneath a swinging door;

c) the base plate extending away from the housing;

d) the electric motor causing rotational movement in a rod extending from inside the housing, to outside the housing and over a surface of the base plate;

e) a door supporting element extending perpendicular to the extended rod; and f) the door supporting element being attached to the extended rod at a proximal location and extending over the surface of the base plate to a distal end so that rotation of the extended rod causes the distal end of the door supporting element to elevate above the base plate to secure an opened door.

12 Claims, 5 Drawing Sheets

(56) References Cited

U.S. PATENT DOCUMENTS 3,777,423 A * 12/1973 Coulter ..... A62C 2/12 49/31
3,778,866 A * 12/1973 Nakanishi ..... E05F 3/16 16/49
3,796,451 A * 3/1974 Schultz ..... E05F 3/222 292/263
3,805,322 A * 4/1974 Serrano ..... E05C 19/004 16/82
3,934,306 A * 1/1976 Farris ..... E05F 3/223 16/48.5
3,955,840 A * 5/1976 Rawls ..... E05B 47/0002 292/229
4,286,810 A * 9/1981 Ehmen ..... E05C 17/50 292/175
4,406,486 A * 9/1983 White ..... E05B 47/0002 292/144
4,631,776 A * 12/1986 King ..... E05C 19/004 16/82
4,702,095 A * 10/1987 Ben-Asher ..... E05B 47/023 292/201
4,797,970 A * 1/1989 Charlton ..... E05C 17/50 16/82
5,035,450 A * 7/1991 Muller ..... E05B 47/0046 292/341.16
5,141,271 A * 8/1992 Geringer ..... E05C 19/166 292/251.5
5,263,347 A * 11/1993 Allbaugh ..... E05B 47/026 292/144
5,515,649 A * 5/1996 Strab ..... E05B 51/02 49/276
6,099,048 A * 8/2000 Salmon ..... E05B 77/52 292/201
6,378,917 B1 * 4/2002 Jones ..... E05C 19/184 16/82
7,350,836 B2 * 4/2008 Simpson ..... E05C 17/48 16/82
7,469,942 B2 * 12/2008 Whitaker ..... E05B 65/108 292/92
8,128,134 B2 * 3/2012 Kelly ..... E05F 5/02 16/82
2004/0094973 A1 * 5/2004 Sprague ..... E05B 1/00 292/336.3
2007/0214725 A1 * 9/2007 Miyashita ..... E05F 15/60 49/340
2007/0251051 A1 * 11/2007 Miyashita ..... E05F 3/102 16/79

FOREIGN PATENT DOCUMENTS

GB 2565116 A * 2/2019 ..... E05C 17/50
WO WO-0073609 A1 * 12/2000 ..... E05C 17/166

* cited by examiner

AUTOMATIC LOCK-UNLOCK DOOR SAFETY CONTROL

BACKGROUND OF THE INVENTION

1. Field of the Invention

The present invention relates to the field of door control systems, and especially temporary door stabilization systems, and systems that temporarily lock doors into a stable open position. As essential as doors are for assisting movement and access through structures, they can often create bottlenecks and cause inconvenience to people, especially those with limited physical abilities.

2. Background of the Art

Doors are part of every human habitable and functional structure. Doors must provide room for entry of carts and wheelchairs, must open easily, provide barrier ability, and yet not swing so freely as to strike individuals after they pass through. These are often competing requirements. Most controls designed for assistance with swinging o sliding doors tend to force opening of doors and closing of doors to assist users. Additional capabilities should still be available from controls on doors.

Examples of door controls may be found as follows.

Published US Patent Application Documents 20070251051 and 20070214725 disclose a door closer used for energizing a door in the direction closing the door, and the door closer has a door-closer main body installed on the door. The door-closer main body includes a hydraulic cylinder. A piston is placed within the hydraulic cylinder for being energized by an elastic body and which has a gear portion formed around its periphery. A gear body is pivoted by the hydraulic cylinder and which engages the gear portion of the piston to cause the piston to slide. A restricting mechanism temporarily restricts the rotation of the gear body when the door is opened. The doors may also have a delay unit for door with a door closer.

Published US Patent Application Document 20040094973 (Sprague) discloses a displaceable door handle system in which a door handle is displaceably mounted to a door body and is shaped so that the pivot point(s) are sufficient operational distances from an actuation surface such that the force necessary to be applied to the actuation surface to release the door is less than a desired parameter. In a preferred embodiment, a generally horizontal surface is provided on the door handle, with two generally vertical surfaces provided on either side of the actuation surface. The pivot mounts for the door handle are provided in the vicinity of the respective ends of the vertical surfaces.

U.S. Pat. No. 5,515,649 (Strab) discloses a door operating system which includes a remotely or manually controlled fluid supply system (10) which pressurizes a reciprocal striker release assembly (50), and activates an opening cylinder assembly (30) functionally mounted to a door (17) and door frame (18) for opening the door. Components of the door operating system include: an air compressor (11); a fluid pressure regulator (15) for ensuring, by virtue of a higher pressure, that the striker release assembly (50) is actuated in a timely manner with respect to the opening of the door due to activation of an opening cylinder (32) and for controlling the power and the speed that the door opens; a three-way solenoid valve (12), manually or remotely actuated, for releasing pressurized fluid to the opening cylinder (32) during the opening cycle and discharging fluid during the closing cycle thereby permitting closing of the door; a pair of clevis brackets (31,33), and a door frame bracket (35) for ease in installation of the opening cylinder (32); and a door closer (34) mounted on a side of the door opposite to the opening cylinder location.

U.S. Pat. No. 3,934,306 (Farris_discloses a safety device for automatically closing a door in response to a predetermined condition, such as fire by a selectively disengageable brake operatively associated with a pivotable door closure arm. The brake includes a flexible cable wrapped around a brake drum, and means to selectively tighten the cable around the drum. A crank-pin rotates conjointly with the drum and engages the door closure arm to expeditiously close the door in the event of fire.

U.S. Pat. No. 3,778,866 (Nakanishi) discloses a door closer having a torsion spring effecting to rotate a door in the closing direction, a brake drum rotating together with rotation of the door, and at least two relative brake shoe units provided at the position of inserting the brake drum for preventing rotation of the brake drum and reducing a closing speed of the door and for frictionally and resiliently pressing brake surfaces of the brake drum, respectively.

U.S. Pat. No. 3,777,423 (Coulter (discloses a surface-mounted door holder-closer responsive to the products of combustion passing through multiple passageways formed in a holder-closer housing cover, a holder-closer assembly frame, and a static shield which is an integral part of an ionization chamber module. The ionization chamber module is insertable into the holder-closer frame with the frame and static shield not only defining the passageways, but also isolating the ion chamber from spurious static charges generated within the housing which would render a false alarm or false emergency door release. The frame also houses the principal components of the holder-closer, namely, a closer spring, a dashpot, a latching lever assembly, and an electromagnet responsive to modulated current flow in the ionization chamber to effect alarm or emergency release of the latching lever to close an otherwise open door. The integrated detector-holder-closer is advantageously and simply mounted on the lintel or header of a door frame.

U.S. Pat. No. 3,648,326 (Gaysowski) discloses an electromechanical door holder-closer to maintain remote fail-safe holding of a door in an open position, and also to effect closure of the door in response to the application of a manual closing force, the opening of an operating switch, the malfunctioning of condition detection circuitry for fire or smoke, or, alternatively, the detection of an undesired condition.

SUMMARY OF THE INVENTION

An electromechanical door supporting system for temporarily maintaining a door in an open position having:

a) a housing containing an electric motor in communication with a power source;

b) a base plate configured to pass underneath a swinging door;

c) the base plate extending away from the housing in a first direction;

d) the electric motor causing rotational movement in an extended rod that extends from inside the housing, to outside the housing and over a surface of the base plate;

e) a door supporting element extending approximately perpendicular to the extended rod; and f) the door supporting element being attached to the extended rod at a proximal location and extending within or over the surface of the base plate to a distal end so that rotation of the extended rod causes the distal end of the door supporting element to elevate above the base plate to provide a supporting area between the door supporting element and the housing.

DETAILED DESCRIPTION OF THE INVENTION

An electromechanical door supporting system for temporarily maintaining a door in an open position having:

a) a housing containing an electric motor in communication with a power source;

b) a base plate configured to pass underneath a swinging door;

c) the base plate extending away from the housing in a first direction;

d) the electric motor causing rotational movement in an extended rod that extends from inside the housing, to outside the housing and over a surface of the base plate;

e) a door supporting element extending approximately perpendicular (e.g., ±25 degrees) to the extended rod; and located and extending within or over the surface of the base plate to a distal end so that rotation of the extended rod causes the distal end of the door supporting element to elevate above the base plate to provide a supporting area between the door supporting element and the housing. If the external rod is within the base plate, there is a hole from a back side of the base plate through the base plate to an opening or a slot-opening on the base plate to the door supporting element.

The following Figure Key will be used in describing the Figures and enhancing an understanding of the invention.

FIGURE KEY

FIG. 1

10—AUTOMATIC LOCK-UNLOCK DOOR SAFETY SYSTEM
12—HOUSING
14—BASE PLATE
16—TOP SURFACE OF BASE PLATE
18—ELEVATING DOOR GRIP
20—SOLENOID DRIVEN, BIASED ROTATING EXTERNAL ROD

FIG. 2

200—DOOR FRAME
202—DOOR
204—SPRING LOADED HINGES
206—DOOR HANDLE
210—DOOR HOLDER ROD
212—DOOR HOLDER

FIG. 3

302*a*—DOOR FRAME
302*b*—DOOR
304—ANTERIOR WALL
306—STAINLESS STEEL ROD
308—DOOR HOLDER

FIG. 4

400—RUBBER ANTI-SKID MAT
402—DOORHOLDER WALL
404—RUBBER BASE
406—SOLENOID
408—NUT
410—SOLENOID ROD
412—PIN
414—STAINLESS STEEL ROD
416—RETURN SPRING
418—SPRING LOOPS
420—EYE SCREW
422—STAINLESS STEEL ROD EYE
424—SOLENOID LEAD WIRES
426—DELAY TIMER
428—MOMENTARY SWITCH
430—ON/OFF SWITCH
432—NEGATIVE BATTERY LEAD
434—POSITIVE BATTERY LEAD
436—BATTERY
438—BATTERY CHARGING HOOK-UP
450—PIVOT POINT CONNECTION TO EXTERNAL ROD

FIG. 5

500—FRONT OF DOOR HOLDER
502—SIDE OF DOOR HOLDER
504—SOLENOID
506—SOLENOID NUT
508—SOLENOID ROD
510—MOMENTARY SWITCH
512—STAINLESS STEEL ROD
514—STAINLESS STEEL ROD
516—LOOP ON END OF ROD
518—BASE
520—RETURN SPRING
522—EYE SCREW
524—DOOR HOLDER SIDE
526—SPRING LOOP
528—DRIVE ROD IN A NON-EXTENDED POSITION
530—LEVER SEGMENT

Figure 1:
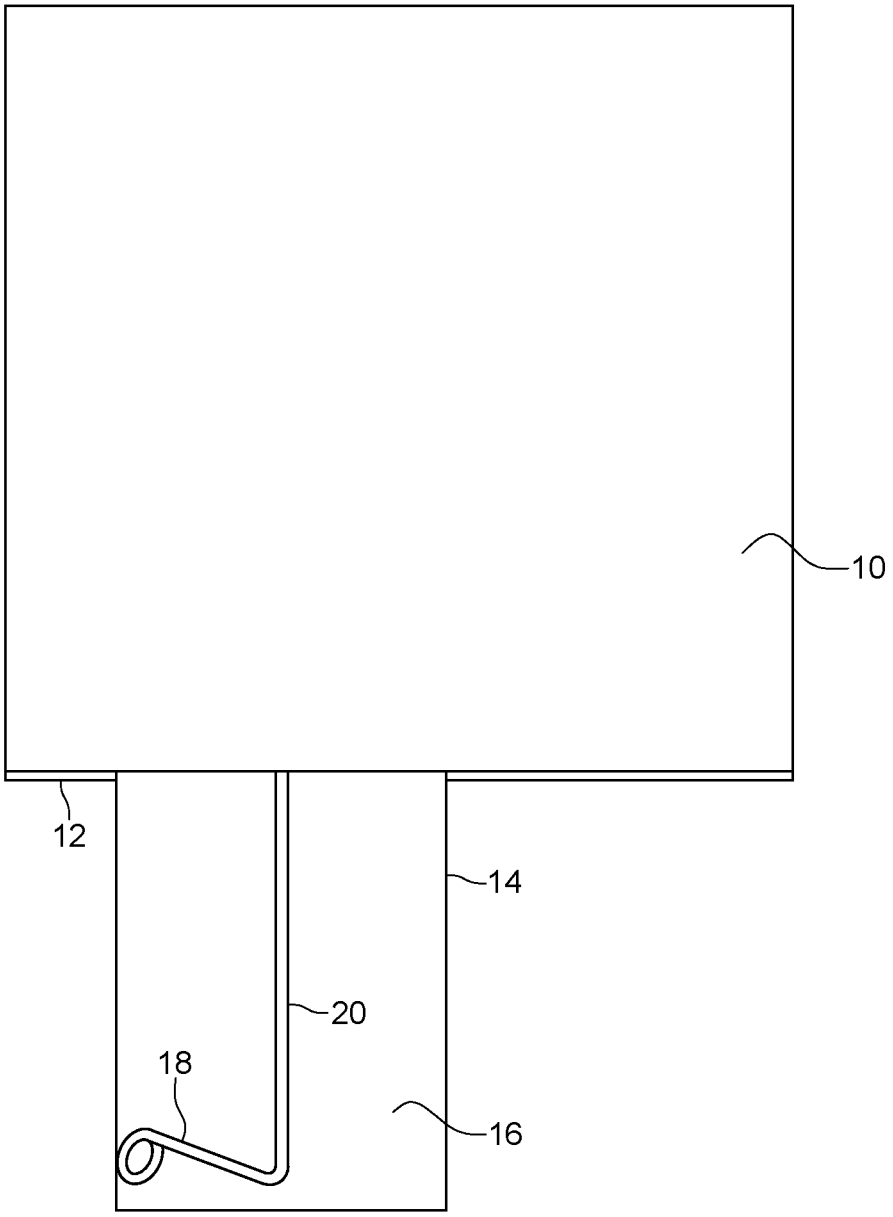
FIG. 1 shows a top view of the open-door supporting device with the door supporting element in a raised position.

FIG. 1 shows a top view of the open-door supporting device 10 with the door supporting element 18 in a raised position. The housing 12 has a base plate 14 extending over a floor surface (not shown), and rotation of the external rotating rod 29 rotates the door-supporting element 18 into a position that will hold the door (not shown) in place in an open position until the door-supporting element 18 is lower to be flush with or below the plane of the top surface 16 of the base plate 14.

Figure 2:
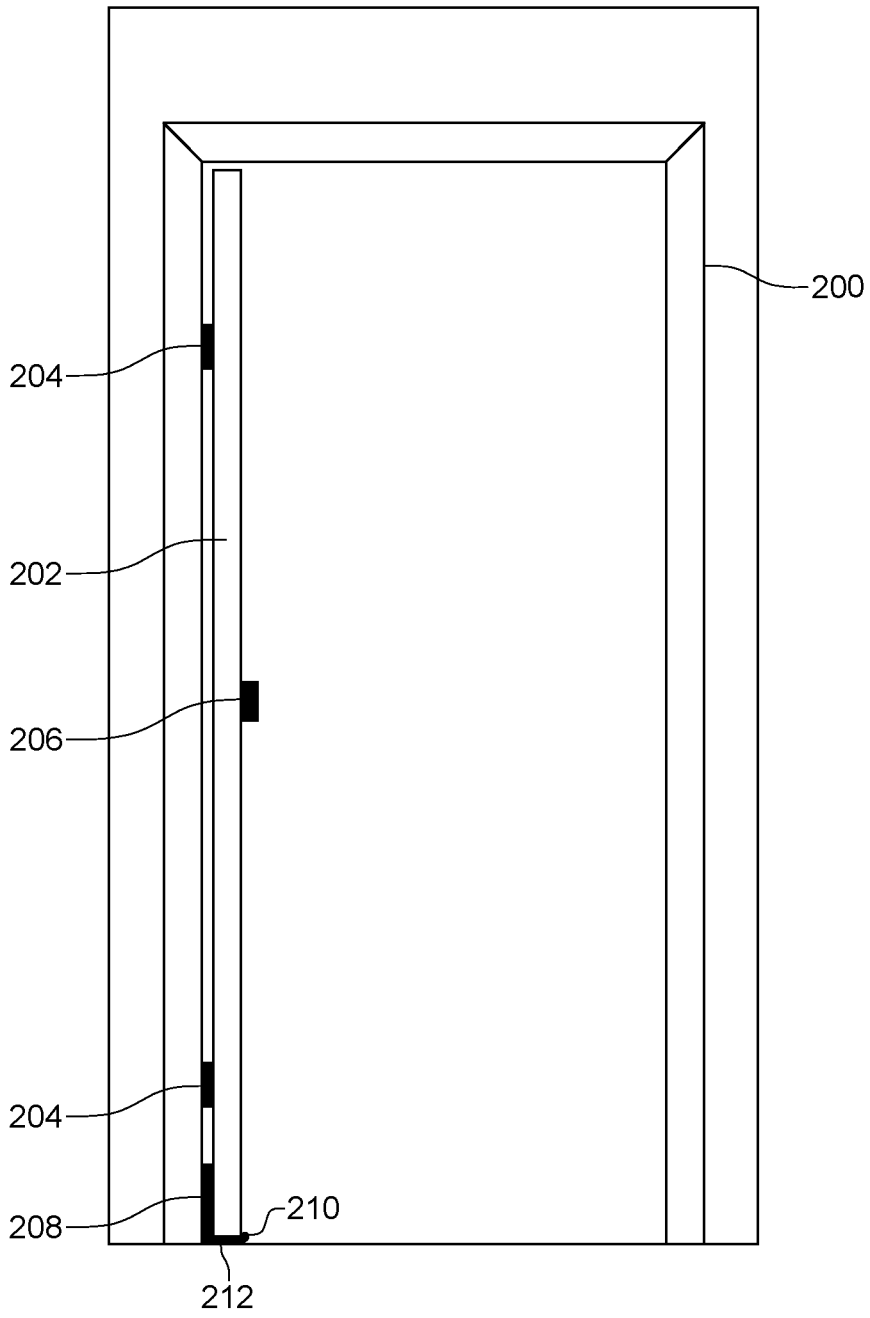
FIG. 2 shows a front view of a door frame with an open door supported by an open-door supporting device of the present invention.

FIG. 2 shows a front view of a door frame 200 with an open door 202 supported by an open-door supporting device 208 of the present invention. The base plate 212 extends below the open door 202 with the door-supporting element 210 supporting the door in an open position. Door hinges 204 and the door handle 206 are shown.

Figure 3:
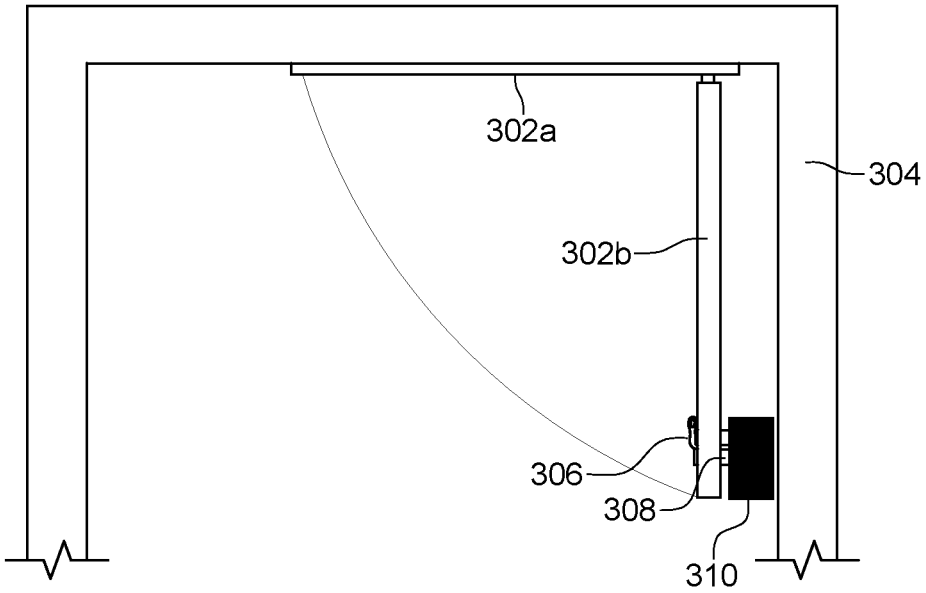
FIG. 3 shows a top view of a door frame with an open door supported by an open-door supporting device of the present invention.

FIG. 3 shows a top view of a door frame 304 with an open door 302*b* supported by an open-door supporting device 310 of the present invention. The position of a closed door 302*a* is also shown. The base plate 308 is shown extending under the open door 302*b* with the elevated door-supporting element 310 supporting the door 302*b* in an open position.

Figure 4:
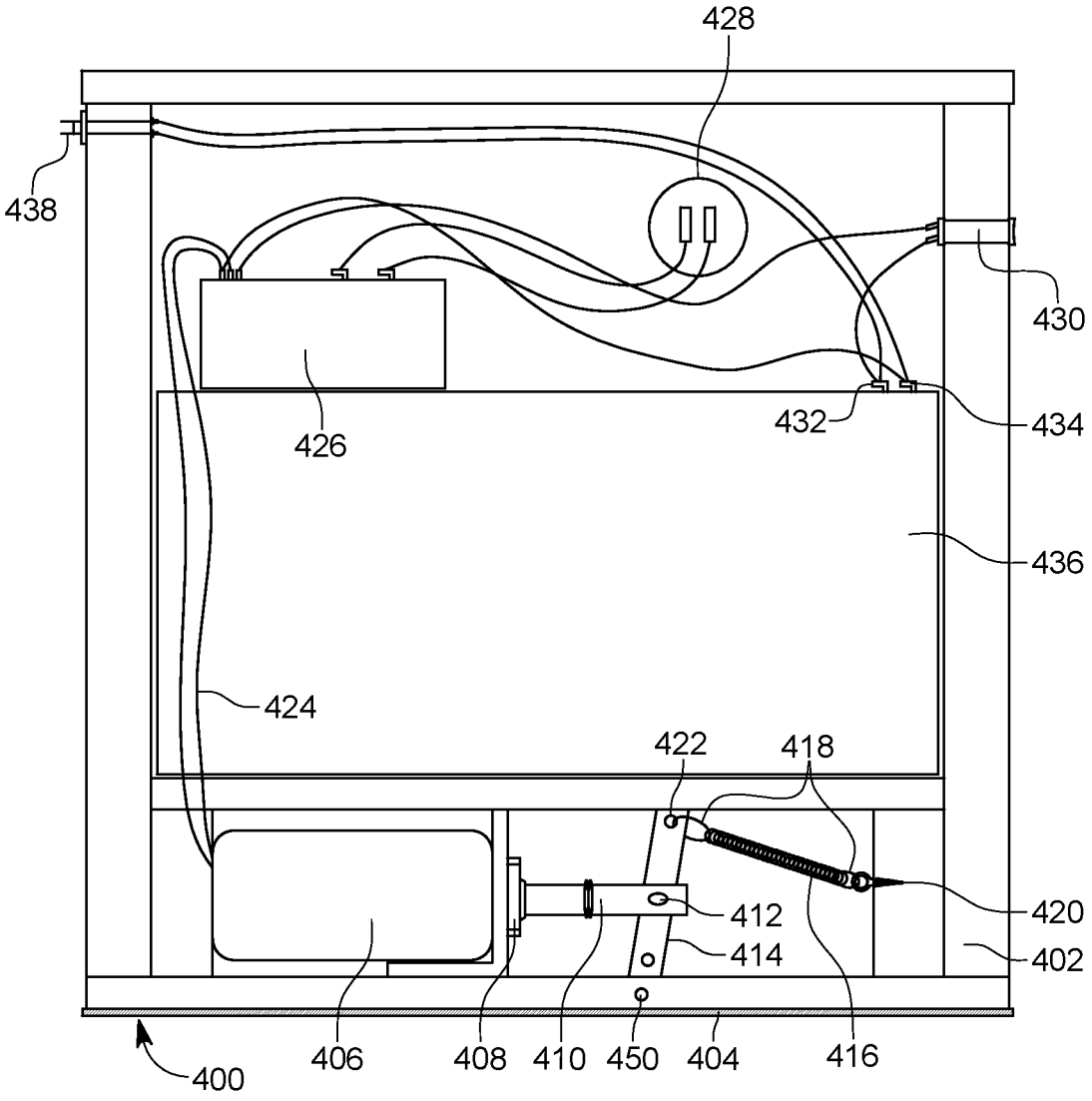
FIG. 4 shows a side cutaway view of internal elements of an open-door supporting device of the present invention.

FIG. 4 shows a side cutaway view of internal elements of an open-door supporting device 400 of the present invention. The open-door supporting device 400 is shown with its housing 402, base plate 404, retraction drive solenoid 406, nut 408, solenoid rod 410 and pin 412. The pin 412 is supporting and applying tension to a pivoting rod 414 (here a metal rod, such as a stainless steel rod). The rod eye 422 is secured by an eye screw 420 which receives a spring loop 418 of a return (biasing) spring 416. As the stainless steel rod eye 422 is retracted by the retraction action of the solenoid 406 against the pivoting rod 414, the extended exterior rod (not shown, see FIG. 5) connected to the pivoting rod with an end shown as a pivot point connection to external rod 450 is rotated (here, counterclockwise) to elevate the door-supporting element (see 310 in FIG. 3). The tension in the spring 416 is maintained or significantly increased to bias the pivoting rod 414 by movement of the stainless steel rod eye 422 which (the entire pivoting rod) is locked into position by the retracted solenoid rod 410 within the solenoid 406. When the retracting solenoid 406 releases the tension retaining the solenoid rod 410 in a retracted position, the tension in the biasing spring 416 extends the solenoid rod, allowing the pivoting rod to rotate clockwise, and causing the pivot point connection to external rod 450 to rotate, returning the exterior rod and door support elements (not shown in this figure) to return to a position that does not restrain a door in an open position, the open door supporting element lying parallel to the base or at least with the head (e.g., the curved head) lying below the bottom of the door, approximately parallel with the base or below parallel. Cables 424 extend from the solenoid 406 to a battery 436 powered delayed timer 426. The delayed time acts on the solenoid, assuring a programmable time in which the door will remain in an open position, once the solenoid 406 has acted to place the open-door support element in a position to maintain the door in a transient open position. Also shown are a momentary switch 428, on-off button 430, negative battery lead 432, positive battery lead 434, rechargeable battery 436 and battery charging lead/hook-up 438. The top of the pivoting rod or plate 414 around the rod eye 422 translates or rotates backwards towards the solenoid 406 as the solenoid rod 408 retracts and the pivoting rod 414 is also retracted to put tension in the biasing spring 416.

Figure 5:
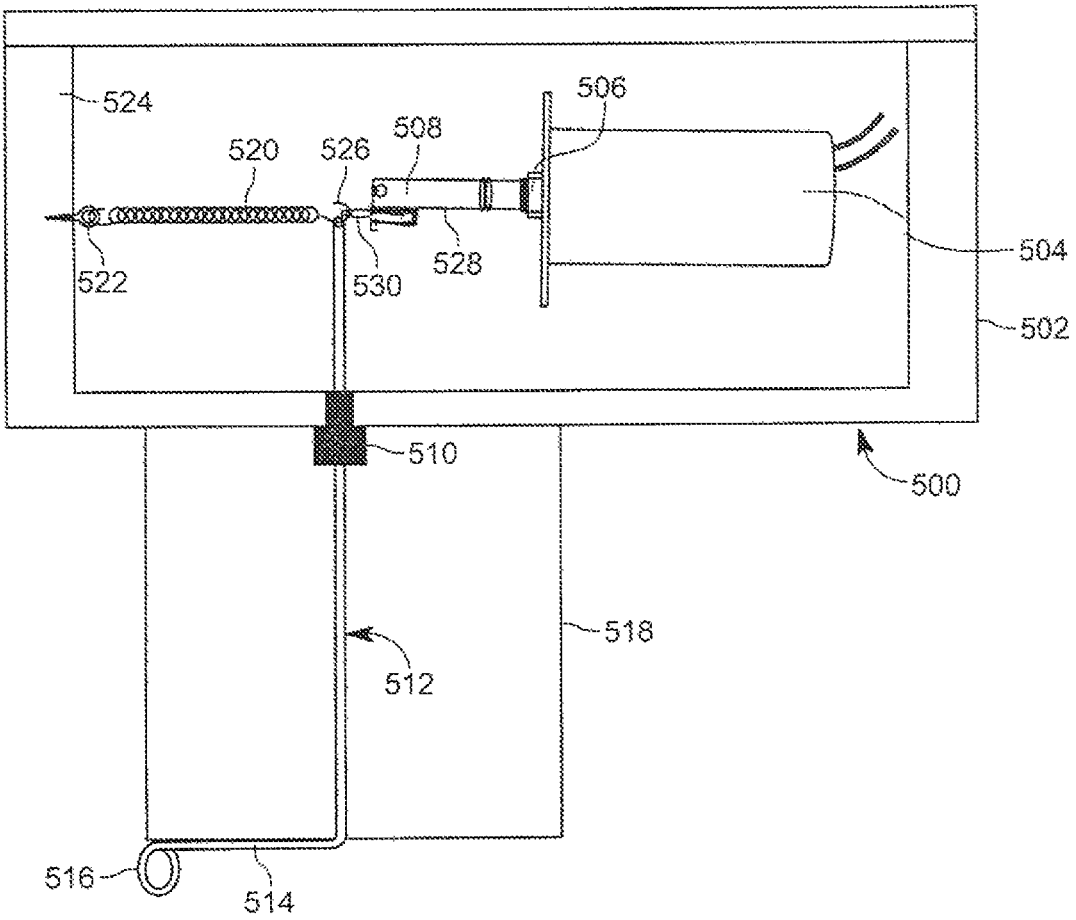
FIG. 5 shows a top cutaway view of internal elements of an open-door supporting device of the present invention.

FIG. 5 shows a top cutaway view of internal elements of an open-door supporting device 500 of the present invention. The device 500 is shown with a housing 502, solenoid 504, stabilizing nut 506, solenoid rod 508, momentary switch 510, internal section of a rotating rod 512 (e.g., metal), external segment of the rotating rod 514, with a loop (or cushioning element) 516 on an end of the rod 514 to minimize scratching of a door or strengthen the end of the rod 514. The base plate 518, return or biasing spring 520 and eye screw 522 screwed into a distal, door supporting end 524 of the housing are also shown. The drive rod 528 from the solenoid 504 is shown in an extended position, driving the lever segment 530 to rotate the internal segment of the rod 512 to elevate the end of the rod 514 above the base plate 518 so that the loop 516 is elevated to contact a door (not shown) to secure it in an open position.

The system may be further described as an electromechanical door supporting system for temporarily maintaining a door in an open position having:

a) a housing containing an electric motor in communication with a power source;

b) a base plate configured to pass underneath a swinging door;

c) the base plate extending away from the housing in a first direction;

d) the electric motor causing rotational movement in an extended rod extending from inside the housing, to outside the housing and over a surface of the base plate;

e) a door supporting element extending approximately perpendicular to the extended rod; and f) the door supporting element being attached to the extended rod at a proximal location and extending over the surface of the base plate to a distal end so that rotation of the extended rod causes the distal end of the door supporting element to elevate above the base plate to provide a supporting area between the door supporting element and the housing.

The electric motor may be a solenoid with a drive rod moveable by the solenoid to cause rotation of the extended rod, and the drive rod of the solenoid may be engaged with a lever segment approximately perpendicular to the extended rod and the lever segment is also engaged with a biasing spring secured within the housing. The drive rod of the solenoid may rotate the extended rod to a closed position when the drive rod is extended from the solenoid, and the biasing spring is in a greatest tension biasing state when the drive rod is extended from the solenoid and the distal end of the of the door supporting element is at least 15 degrees above parallel with the base plate. When the drive rod is in a non-extended position with respect to the solenoid, the biasing spring is maintained in a minimum tension biasing state and the distal end of the of the door supporting element is parallel to or below parallel with the base plate. The lever segment pivots about a middle section of the lever segment about a distal end of the drive rod. The power source may be a battery within the housing, or a receptor for an electrical cord in connection with an external AC power source. A timing circuit may be present to limit an amount of time in which the door supporting element is maintained above parallel alignment with the base plate, and where a timing circuit is present to limit an amount of time in which the door supporting element is maintained above parallel alignment with the base plate in which the timing circuit times release of the drive rod so that a biasing spring provides torque against the extended rod to return the distal end of the door supporting element to return to a position parallel to or below parallel to the base plate.

The invention also includes a method of use of the apparatus includes a method of automatically and temporarily maintaining a swinging door in an open position including:

a) providing an electromechanical door supporting system for temporarily maintaining a door in an open position having:

a) a housing containing an electric motor in communication with a power source;

b) a base plate configured to pass underneath a swinging door;

c) the base plate extending away from the housing in a first direction;

d) the electric motor causing rotational movement in an extended rod extending from inside the housing, to outside the housing and within or over a surface of the base plate;

e) a door supporting element extending approximately perpendicular to the extended rod; and f) the door supporting element being attached to the extended rod at a proximal location and extending over the surface of the base plate to a distal end so that rotation of the extended rod causes the distal end of the door supporting element to elevate above the base plate to provide a supporting area between the door supporting element and the housing;

the method including activating the electric motor to cause the rotational movement in an extended rod, tension or force from the electric motor at least partially maintaining the extended rod to remain in a rotated position in which the distal end of the door supporting element maintains the door in an open position. The electric motor may cause rotational movement creates tension in a biasing spring within the housing, with tension counter to a direction of rotation of the extended rod in its rotated position. The tension or force from the electric motor may be ceased (e.g., by the timing mechanism) ceased and the tension in the biasing spring causes the extended rod to counter rotate to a position in which the distal end of the door supporting element does not maintain the door in an open position. The electric motor may be a solenoid motor and the solenoid motor drives a solenoid rod to cause the rotational movement in the extended rod. The solenoid retracts the solenoid rod to cause rotation in the extended rod and create tension in the biasing spring.

What is claimed:

1. An electromechanical door supporting system for temporarily maintaining a door in an open position comprising:

a) a housing containing an electric motor in communication with a power source;

b) a base plate configured to pass underneath a swinging door;

c) the base plate extending away from the housing in a first direction;

d) the electric motor causing rotational movement in an extended rod extending from inside the housing, to outside the housing and over a surface of the base plate, wherein the electric motor is a solenoid with a drive rod moveable by the solenoid to cause rotation of the extended rod, and wherein the drive rod of the solenoid is engaged with a lever segment approximately perpendicular to the extended rod, connected to the housing and the lever segment is also engaged with a biasing spring secured within the housing causing biasing tension against the lever segment engaged with the drive rod;

e) a door supporting element extending approximately perpendicular to the extended rod; and f) the door supporting element being attached to the extended rod at a proximal location and extending over the surface of the base plate to a distal end so that rotation of the extended rod causes the distal end of the door supporting element to elevate above the base plate to provide a supporting area between the door supporting element and the housing.

2. The system of claim 1 wherein the drive rod of the solenoid rotates the extended rod to a closed position when the drive rod is extended from the solenoid, and the biasing spring is in a greatest tension biasing state when the drive rod is extended from the solenoid and the distal end of the of the door supporting element is at least 15 degrees above parallel with the base plate.

3. The system of claim 2 wherein when the drive rod is in a non-extended position with respect to the solenoid, the biasing spring is maintained in a minimum tension biasing state and the distal end of the of the door supporting element is approximately parallel to or below parallel with the base plate.

4. The system of claim 3 wherein the lever segment rotates about a pivot point connection to external rod to increase tension in the biasing spring when the door supporting element is in a door supporting position.

5. The system of claim 1 wherein the power source comprises a battery within the housing.

6. The system of claim 1 wherein the power source comprises a receptor for an electrical cord in connection with an external AC power source.

7. The system of claim 1 wherein a timing circuit is present to limit an amount of time in which the door supporting element is maintained above parallel alignment with the base plate.

8. The system of claim 1 wherein a timing circuit is present to limit an amount of time in which the door supporting element is maintained above parallel alignment with the base plate in which the timing circuit times release of the drive rod so that a biasing spring provides torque against the extended rod to return the distal end of the door supporting element to return to a position parallel to or below parallel to the base plate.

9. A method of automatically and temporarily maintaining a swinging door in an open position comprising:

a) providing an electromechanical door supporting system for temporarily maintaining a door in an open position having:

a) a housing containing an electric motor in communication with a power source;

b) a base plate configured to pass underneath a swinging door;

c) the base plate extending away from the housing in a first direction;

the electric motor comprising a drive rod operatively connected to a lever segment, the lever segment connected to the housing and to an extended rod, operation of the electric motor causing rotational movement in the extended rod extending from inside the housing, to outside the housing and over a surface of the base plate, wherein the electric motor causing rotational movement creates a tension in a biasing spring within the housing, with tension counter to a direction of rotation of the extended rod in its rotated position causing biasing tension against the lever segment engaged with the drive rod;

e) a door supporting element extending approximately perpendicular to the extended rod; and f) the door supporting element being attached to the extended rod at a proximal location and extending over the surface of the base plate to a distal end so that rotation of the extended rod causes the distal end of the door supporting element to elevate above the base plate to provide a supporting area between the door supporting element and the housing;

the method including activating the electric motor to cause the rotational movement in an extended rod, tension or force from the electric motor at least partially maintaining the extended rod to remain in a rotated position in which the distal end of the door supporting element maintains the door in an open position.

10. The method of claim 9 wherein the tension or force from the electric motor is ceased and the tension in the biasing spring causes the extended rod to counter rotate to a position in which the distal end of the door supporting element does not maintain the door in an open position.

11. The method of claim 10 wherein the electric motor is a solenoid motor and the solenoid motor drives a solenoid rod to cause the rotational movement in the extended rod.

12. The method of claim 11 wherein the solenoid retracts the solenoid rod to cause rotation in the extended rod and create tension in the biasing spring.

* * * * *